US010844772B2

(12) United States Patent
Gonze et al.

(10) Patent No.: US 10,844,772 B2
(45) Date of Patent: Nov. 24, 2020

(54) THERMAL MANAGEMENT SYSTEM AND METHOD FOR A VEHICLE PROPULSION SYSTEM

(71) Applicant: GM GLOBAL TECHNOLOGY OPERATIONS LLC, Detroit, MI (US)

(72) Inventors: Eugene V. Gonze, Pinckney, MI (US); Daniel J. Shepard, Ann Arbor, MI (US); Lawrence P. Ziehr, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 364 days.

(21) Appl. No.: 15/922,190

(22) Filed: Mar. 15, 2018

(65) Prior Publication Data

US 2019/0284986 A1 Sep. 19, 2019

(51) Int. Cl.

| | |
|---|---|
| ***F01P 7/16*** | (2006.01) |
| ***F01P 3/02*** | (2006.01) |
| ***F01P 11/18*** | (2006.01) |
| ***F01P 7/14*** | (2006.01) |

(52) U.S. Cl.

CPC ..... *F01P 7/167* (2013.01); *F01P 3/02* (2013.01); *F01P 7/164* (2013.01); *F01P 11/18* (2013.01); *F01P 2003/024* (2013.01); *F01P 2007/146* (2013.01); *F01P 2025/06* (2013.01); *F01P 2025/32* (2013.01); *F01P 2025/44* (2013.01); *F01P 2025/46* (2013.01)

(58) Field of Classification Search

CPC ..... F01P 11/18; F01P 2003/024; F01P 2003/027; F01P 2003/028; F01P 2007/146; F01P 2025/04; F01P 2025/06; F01P 2025/30; F01P 2025/31; F01P 2025/32; F01P 2025/36; F01P 2025/44; F01P 2025/46; F01P 2060/04; F01P 2060/045; F01P 2060/08; F01P 2060/12; F01P 3/02; F01P 7/164; F01P 7/165; F01P 7/167

See application file for complete search history.

(56) References Cited

U.S. PATENT DOCUMENTS

| | | | | |
|---|---|---|---|---|
| 5,851,399 | A | 12/1998 | Leitzke | |
| 8,342,141 | B2 | 1/2013 | Dahl et al. | |
| 8,813,692 | B2 | 8/2014 | Bialas et al. | |
| 9,151,211 | B2 | 10/2015 | Anilovich et al. | |
| 9,611,781 | B2 | 4/2017 | Moscherosch et al. | |
| 9,638,139 | B2 | 5/2017 | Ryan et al. | |
| 9,719,408 | B2 | 8/2017 | Gonze et al. | |
| 2011/0259287 | A1* | 10/2011 | Kakehashi | F01P 7/164 123/41.09 |
| 2015/0217622 | A1* | 8/2015 | Enomoto | B60L 1/003 165/42 |

* cited by examiner

*Primary Examiner* — Hung Q Nguyen
*Assistant Examiner* — Ruben Picon-Feliciano

(57) ABSTRACT

A vehicle propulsion system includes an engine having a coolant inlet and a coolant outlet, a coolant pump having an outlet in communication with the engine coolant inlet, a pressure sensor in fluid communication with the engine coolant outlet and that generates a pressure signal indicative of a pressure in the engine coolant outlet, and a controller in communication with the pressure sensor and the coolant pump. The controller is programmed to control a flow of coolant through the engine from the coolant pump based upon the pressure signal.

3 Claims, 4 Drawing Sheets

THERMAL MANAGEMENT SYSTEM AND METHOD FOR A VEHICLE PROPULSION SYSTEM

FIELD

The present disclosure relates to thermal management system and method for a vehicle propulsion system.

INTRODUCTION

This introduction generally presents the context of the disclosure. Work of the presently named inventors, to the extent it is described in this introduction, as well as aspects of the description that may not otherwise qualify as prior art at the time of filing, are neither expressly nor impliedly admitted as prior art against this disclosure.

Current production motor vehicles, such as the modern-day automobile, are originally equipped with a powertrain that operates to propel the vehicle and power the onboard vehicle electronics. In automotive applications, for example, the propulsion system may be generally typified by a prime mover that delivers driving power through a transmission to a final drive system (e.g., rear differential, axles, and road wheels). Automobiles have traditionally been powered by a reciprocating-piston type internal combustion engine assembly because of its ready availability and relatively inexpensive cost, light weight, and overall efficiency. Such engines may include, for example, compression-ignited (CI) diesel engines, spark-ignited (SI) gasoline engines, flex-fuel models, two, four and six-stroke architectures, and rotary engines, as some non-limiting examples. Hybrid and full-electric vehicles, on the other hand, may utilize alternative power sources, such as fuel-cell or battery powered electric motor-generators, to propel the vehicle and minimize/eliminate reliance on a combustion engine for power.

During normal operation, internal combustion engine (ICE) assemblies and large traction motors (i.e., for hybrid and full-electric powertrains) may generate a significant amount of heat. To prolong the operational life of the prime mover(s) and the various components packaged within the engine compartment, vehicles may be equipped with passive and active features for managing heat in the engine bay. Passive measures for alleviating excessive heating within the engine compartment may include, for example, thermal wrapping the exhaust runners, thermal coating of the headers and manifolds, and integrating thermally insulating packaging for heat sensitive electronics. Active means for cooling the engine compartment include radiators, coolant pumps, and fans. As another option, some vehicle may include vents that expel hot air and amplify convective cooling within the engine bay.

Active thermal management systems for vehicles may employ an onboard vehicle controller or electronic control module to regulate operation of a cooling circuit that distributes liquid coolant, generally of oil, water, and/or anti-freeze, throughout the components of the vehicle. A coolant pump may propel cooling fluid through coolant passages in the engine block, the transmission case and sump, and to a radiator or other heat exchanger. A radiator may transfer heat from the vehicle to ambient air. Some thermal management systems may use a split cooling system layout that features separate circuits and water jackets for the cylinder head and engine block such that the head can be cooled independently from the block. The cylinder head, which has a lower mass than the engine block and is exposed to very high temperatures, heats up much faster than the engine block and, thus, generally needs to be cooled first. Advantageously, during warm up, a split layout allows the system to first cool the cylinder head and, after a given time interval, then cool the engine block.

Conventional thermal management systems for vehicle propulsion systems include a coolant pump which always provides more coolant to the engine than necessary. This may generally be known as "overflowing" the engine. This approach ensures that the risk of the coolant boiling during the vast majority of operating conditions is minimized. Coolant boiling is undesirable for multiple reasons, including a reduction in the ability to supply a sufficient mass of coolant to remove heat, and risks associated with cooling fluids escaping from the system. Therefore, it is desirable to avoid coolant boiling in a vehicle thermal management system. A coolant overflowing thermal management system operates to provide a flow of coolant which exceeds an optimal flow of coolant by a large safety factor or offset. Thus, under a majority of operating conditions these systems are not able to provide the optimal thermal conditions for the engine. Optimal thermal conditions for an engine may require a higher temperature than is permitted in a conventional engine coolant overflow system. For example, engine performance and efficiency may be improved by maintaining a higher combustion wall temperature than is permitted under most conditions with these conventional thermal management systems.

SUMMARY

In an exemplary aspect, a vehicle propulsion system includes an engine having a coolant inlet and a coolant outlet, a coolant pump having an outlet in communication with the engine coolant inlet, a pressure sensor in fluid communication with the engine coolant outlet and that generates a pressure signal indicative of a pressure in the engine coolant outlet, and a controller in communication with the pressure sensor and the coolant pump. The controller is programmed to control a flow of coolant through the engine from the coolant pump based upon the pressure signal.

In this manner, an exemplary embodiment of the thermal management system for a vehicle propulsion system in accordance with the present disclosure greatly improves the ability to maximize CO2 benefits, fuel economy, emissions, performance and the like without limitation by, for example, improving the ability to thermally manage the vehicle propulsion system which may optimize thermal conditions in an engine while minimizing the risk of coolant boiling.

In another exemplary aspect, the controller is further programmed to compare the pressure signal to a threshold and wherein the controller controls the flow of coolant based upon the comparison.

In another exemplary aspect, the controller is further programmed to determine a derivative of the pressure signal and to control the flow of coolant based upon the pressure signal derivative.

In another exemplary aspect, the coolant pump is an electrically controlled variable flow coolant pump.

Further areas of applicability of the present disclosure will become apparent from the detailed description provided below. It should be understood that the detailed description and specific examples are intended for purposes of illustration only and are not intended to limit the scope of the disclosure.

The above features and advantages, and other features and advantages, of the present invention are readily apparent from the detailed description, including the claims, and exemplary embodiments when taken in connection with the accompanying drawings.

BRIEF DESCRIPTION OF THE DRAWINGS

The present disclosure will become more fully understood from the detailed description and the accompanying drawings, wherein.

DETAILED DESCRIPTION

Figure 1:
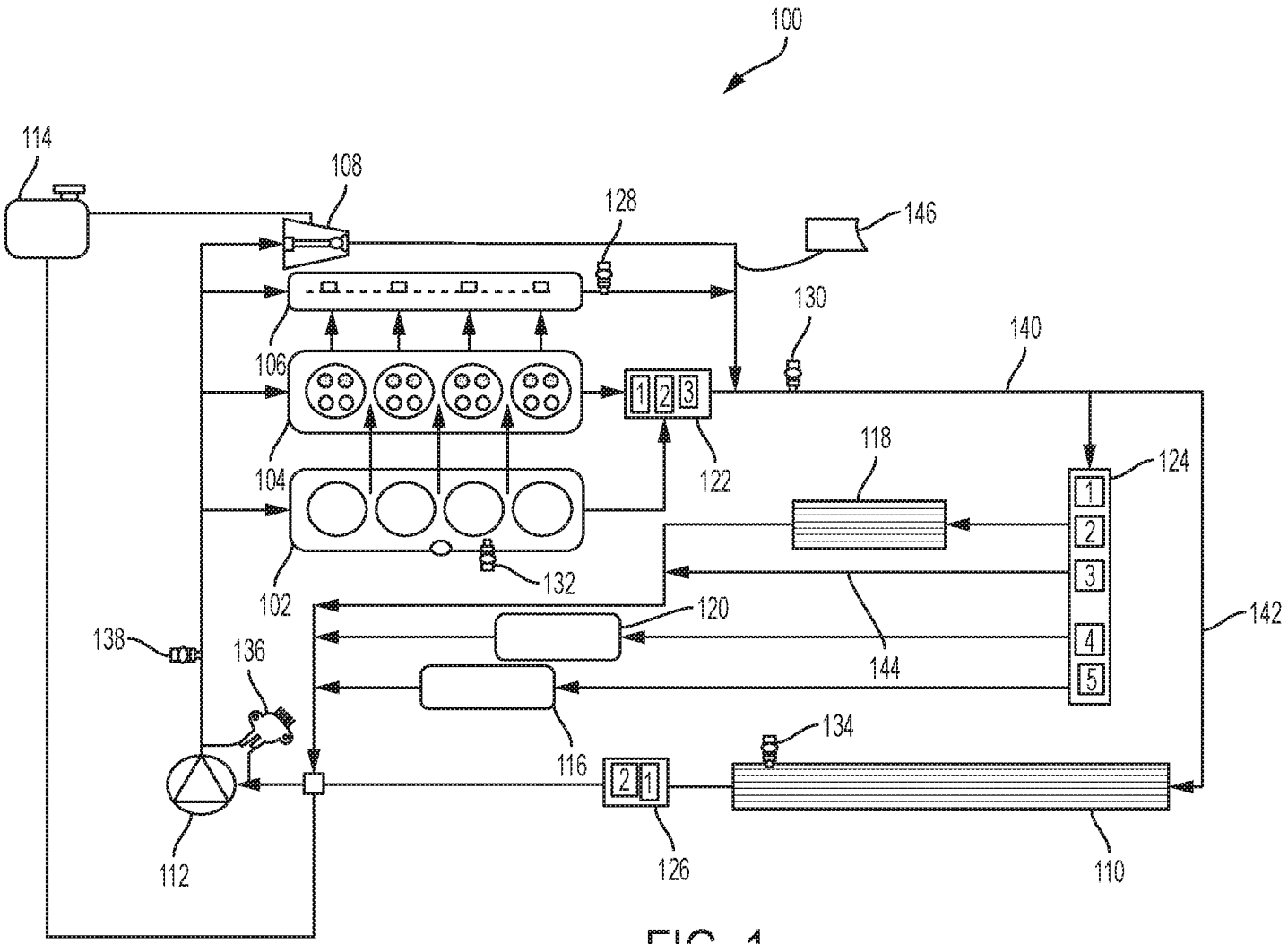
FIG. 1 is a schematic illustration of an exemplary thermal management system for a vehicle in accordance with the present disclosure.

FIG. 1 illustrates an exemplary active thermal management system 100 for various components in a vehicle. The thermal management system includes an engine block 102, a cylinder head 104, and an exhaust manifold 106. The exhaust manifold may be an integrated exhaust manifold in which the exhaust manifold is integrated into the cylinder heading, a separate (non-integrated) exhaust manifold and/or the like without limitation which has a cooling jacket through which coolant flows. The thermal management system 100 further includes a forced-induction component 108, such as, for example, a turbocharger. In other exemplary embodiments in accordance with the present application, the forced-induction component 108 may be a supercharger, a twin-charger, a variable geometry turbine (VGT) with a VGT actuator arranged to move the vanes to alter the flow of exhaust gases through the turbine, and/or the like without limitation. Alternatively, the thermal management system might not include a forced-induction component and be naturally aspirated. The invention of the present disclosure is applicable in either configuration.

The thermal management system 100 further includes a heat exchanger (or radiator) 110, for exchanging heat between an internally flowing liquid coolant and an external fluid medium (ambient air) and/or an internal fluid medium (refrigerant). A coolant pump 112, which may be of the fixed, positive or variable displacement type, is operable for circulating liquid coolant cooled by the radiator 110 throughout the system 100. In a preferred embodiment, the pump 112 may be an electric pump which provides increased control over the volume of flow in comparison to a mechanical pump which only vary the volume of flow based upon the operated speed of the engine. In this manner, a pump having a controllable volume of flow enables significantly improved control over the amount of heat which may be transferred to, distributed between, and/or rejected from components within a vehicle. A surge tank 240 may provide a temporary storage container for retaining coolant overflow due to expansion of the coolant as it heats up, and returning coolant when cooled.

Thermal management system 100 is a split cooling system layout for independently managing heat-extracting coolant flow through the block 102, head 104, exhaust manifold 106, and turbocharger 108—and a transmission heat exchanger 116. The illustrated thermal management system 100 also independently manages coolant flow to the radiator 110, a cabin heater core 118, engine oil heat exchanger 120, and the transmission heat exchanger 116. With this configuration, the thermal management system 100 is capable of separately and independently controlling which part or parts of the engine to cool at a given time, and to which component or components of the vehicle propulsion system or passenger cabin energy will be delivered in the form of heated coolant. Coolant circulation may be governed by a controller (not shown) through controlled operation of at least the pump 112, an engine rotary valve 122, a main rotary valve 124, and radiator valve 126. The controller may control operation of the pump 112, and valves 122, 124, and 126, in response to signals received from sensors, such as, for example, manifold outlet temperature sensor 128, engine outlet temperature sensor 130, block temperature sensor 132, radiator coolant temperature sensor 134, pump pressure sensor 136, engine inlet temperature sensor 138, coolant pressure sensor 146, and/or the like without limitation. The controller may be incorporated into, be distinct from yet collaborative with, or be fabricated as a wholly independent from other controllers in the vehicle and/or vehicle propulsion system.

The thermal management system 100 employs several branches of conduits for fluidly connecting the illustrated components and splitting the coolant flow among the several loops of the system. The thermal management system 100 may include an engine outlet conduit 140 which receives all coolant flowing through the block 102, the head 104, the manifold 106, and the turbocharger 108, the proportions through each of those components being determined by the engine rotary valve 122. In a preferred, exemplary embodiment, the coolant pressure sensor 146 is positioned to sense the pressure of the coolant in the engine outlet conduit 140. In this manner, the coolant pressure sensor 146 is positioned to sense the pressure of the coolant where the coolant is most likely at the highest temperature and, thus, pressure in comparison to other potential locations in the system 100.

The thermal management system 100 may also include a radiator conduit 142 having an inlet in communication with the engine outlet conduit 140 and an outlet in communication with an inlet to the pump 112. The flow of coolant through the radiator conduit 142 is determined by the radiator valve 126. An independently controlled radiator conduit which places the radiator on its own, completely separate, and independent flow path feature is quite unique and not present in convention vehicle thermal management systems. This obviates the necessity of providing a radiator bypass flow path which is directly tied to the flow through the radiator, as may be found in many conventional thermal management systems. In contrast, the exemplary thermal management system architecture enables complete control over the amount of energy rejected from the system overall, via the radiator, and enables independent and complete control over the distribution of heat to vehicle components which may consume (distribute heat to vehicle components other than those directly related to the engine) and/or maintain heat within the system via the use of a bypass conduit 144 which then returns the heat energy back to the engine components. In this manner, control over the heat energy present within the entire thermal management system may be directly and independently controlled. Thereby further enabling distribution of heat between components that may benefit from additional heat rather than rejecting and/or wasting that heat energy by rejecting it to the ambient environment as has been done by conventional vehicle thermal management systems.

Co-pending, co-assigned U.S. patent application Ser. No. 15/145,417, the disclosure of which is hereby incorporated herein in its entirety, discloses an inventive thermal management system having a radiator conduit which is separate from and independently controlled from other flow paths. As described above, this enables consideration of overall system heat when deciding whether and when to reject heat from the overall system. However, in contrast to the present disclosure, that disclosure describes a system and method which determines the flow through the radiator based upon the cooling requirements of the engine only, and does not consider the thermal considerations of other components within the vehicle.

The main rotary valve 124 also has an inlet in communication with the engine outlet conduit 140 and, in combination with the radiator valve 126, determines the proportion of flow through that valve 124 and into one or more heat exchangers, such as, for example, the cabin heater core 118, the engine oil heater 120, and transmission heat exchanger 116, and/or through a bypass conduit 144. In this manner, through control over the main rotary valve 124, the radiator valve 126 and the pump 112, unprecedented flexibility is achieved in how much heat may be independently transferred between components in the vehicle, rejected to the ambient environment (via the radiator 110), and/or maintained within the system (via the bypass conduit 144). In other words, the inventive thermal management system of the present application may be broadly characterized by a plurality of operating modes: 1) a bypass mode, 2) a heat rejection mode; 3) a heat transfer mode; and 4) any combination of these modes.

It is further envisioned that the number, arrangement, and individual characteristics of the fluid ports in any given valve may be varied from that which are shown in the drawings and remain within the scope of the present disclosure.

The inventors of the present disclosure realized that the optimum distribution of heat with a vehicle thermal management system may be determined based upon various loss functions for each component within the vehicle thermal management system. Additional description of the vehicle thermal management system is found in co-pending, co-assigned U.S. patent application Ser. No. 15/883,257, the disclosure of which is hereby incorporated by reference in its entirety. In an exemplary embodiment of the system and method of the present disclosure, a coolant pressure sensor 146 provides the ability to directly sense the pressure of coolant in the system which, in turn, enables the thermal management system to better optimize the flow of coolant through the system such that thermal conditions of the engine and associated systems permit improved performance, efficiency, fuel economy, and reduced emissions.

Figure 2:
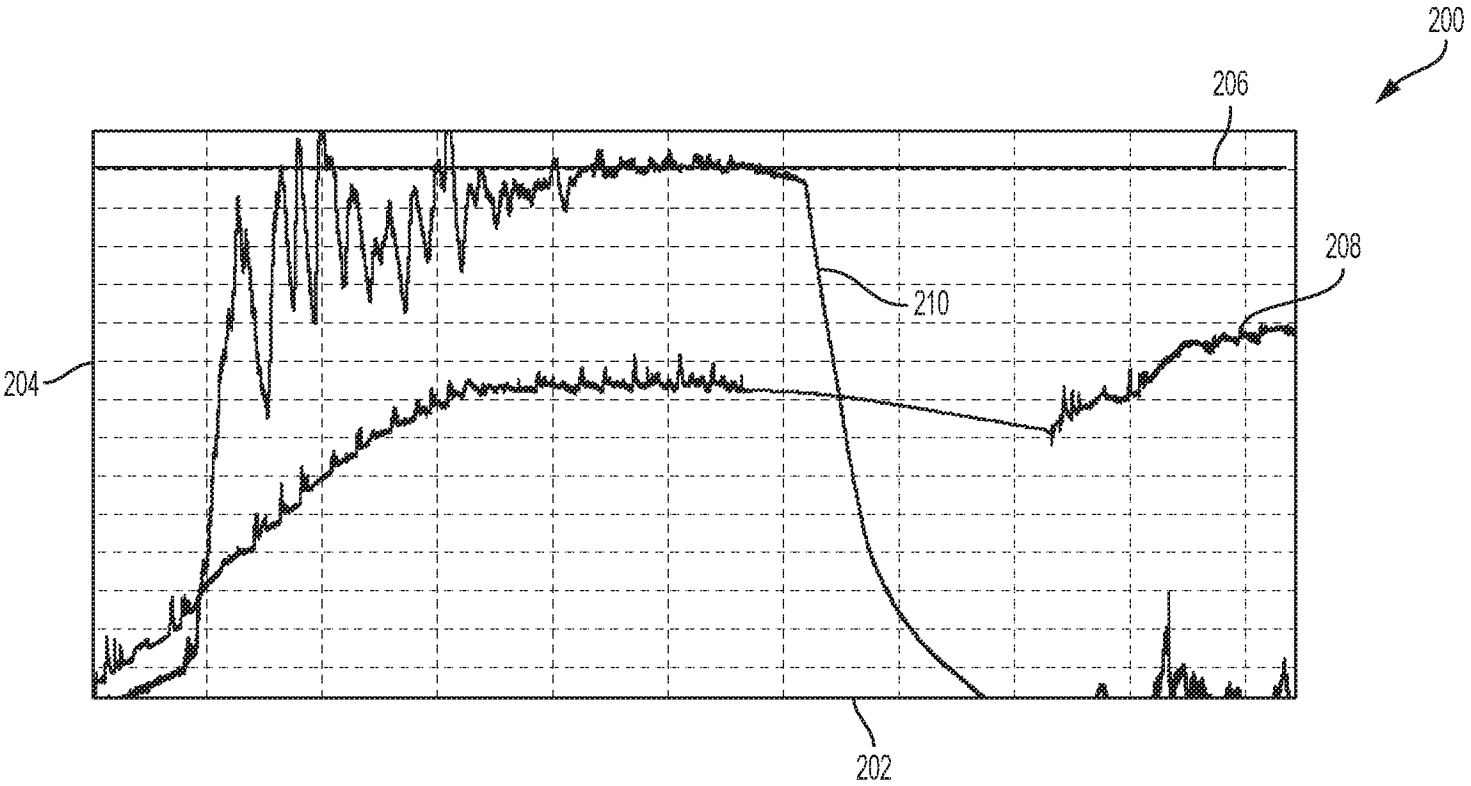
FIG. 2 illustrates a graph 200 of pressures in two conventional vehicle propulsion system thermal management systems.

FIG. 2 illustrates a graph 200 of pressures in two conventional vehicle propulsion system thermal management systems. The horizontal axis 202 of the graph corresponds to the passage of time and the vertical axis 204 represents the amplitude of coolant pressure in the systems. The horizontal line 206 indicates a threshold pressure at which a thermal valve will open and release pressure, and coolant, from the system. The graph 200 generally illustrates the pressures of two conventional systems undergoing a Federal Test Procedure (FTP) in which emissions may be monitored. As explained previously, many conventional thermal management systems provide a sufficient "overflow" of coolant which ensures that temperatures and pressures in the system do not get near the threshold pressure 206. A first line 208 indicates a pressure response in such an overflow system. As is clearly illustrated, there is a large offset between the first pressure response 208 and the threshold pressure 206. For purposes of comparison, a second pressure response 210 is illustrated for a thermal management system in which boiling of the coolant is permitted, or uncontrolled. Each spike in the second pressure response 210 corresponds to an instant at which the coolant in the system boils. When the coolant boils, the pressure quickly rises, exceeds the threshold pressure which causes a valve to open to release the pressure and coolant from the system. The pressure quickly lowers, but again quickly rises again. Thus, the second pressure response 210 of the uncontrolled system repeatedly results in coolant boiling, which results in a valve opening and loss of coolant.

Figure 3:
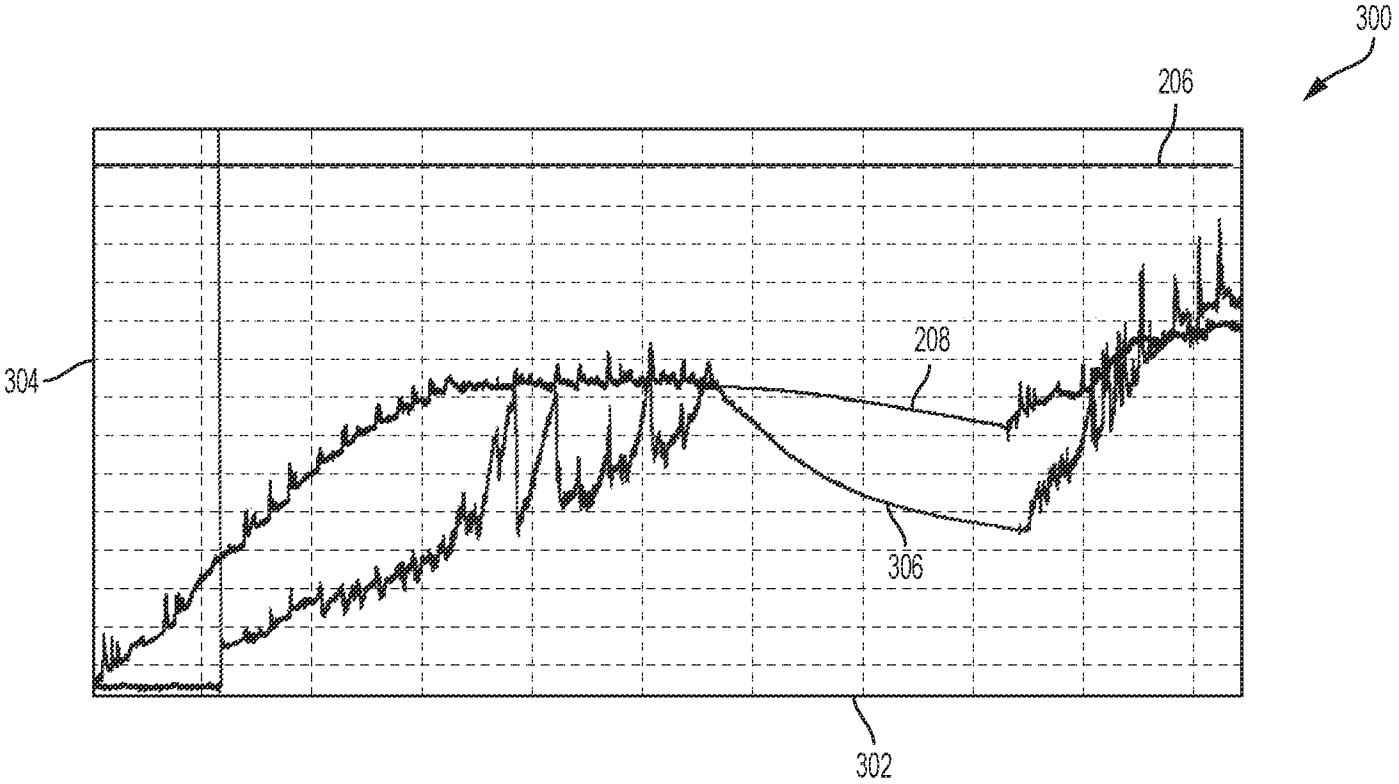
FIG. 3 illustrates a graph 300 for two thermal management systems during a FTP cycle.

FIG. 3 illustrates a graph 300 for two thermal management systems during a FTP cycle. Similar to the graph 200 of FIG. 2, the horizontal axis 302 corresponds to the passage of time and the vertical axis 304 represent the amplitude of pressure. The pressure threshold 206 and the pressure response 208 from a conventional thermal management system from FIG. 2 is also illustrated on the graph 300 of FIG. 3. In an exemplary embodiment of the present disclosure a controller adjusts the flow of coolant from the coolant pump 122 based upon the pressure signal from the coolant pressure sensor 146. A resultant pressure response 306 at the coolant pressure sensor 146 is illustrated in FIG. 3. In this manner, the amount of boiling of the coolant is minimized while maximizing engine performance, fuel economy, efficiency, and emissions reduction. In an exemplary embodiment, the coolant flow from the coolant pump is adjusted based upon a derivative of the pressure signal from the coolant pressure sensor 146. Further, the improvement in the ability to accurately and more closely follow optimum pressure and temperature conditions through the use of the present disclosure enables a potential reduction in the system mass. A reduction in mass enables an improvement in responsiveness and also concomitant improvements in performance, efficiency, fuel economy, emissions reduction and the like.

Further, in accordance with an exemplary embodiment of the present disclosure, a more aggressive engine warming strategy may be achieved while avoiding the adverse consequences of excessive coolant boiling and/or an escape of coolant from the system. Additionally, the ability to better optimize the thermal conditions of the engine not only improves performance, fuel economy, efficiency, and emissions, but also results in the ability to improve the durability and reliability of the engine and associated vehicle propulsion system. The present disclosure enables much greater control over coolant boiling which, in turn, enhances engine durability.

In contrast to conventional thermal management systems, which may rely upon a release valve having a predetermined threshold pressure at which the valve opens and/or a system which provides a sufficient overflow of coolant such that the predetermined threshold pressure is never reached, the present disclosure enables a flexible, calibratable, and adjustable threshold to be determined based up any number of desired engine operating conditions to be optimized. As is illustrated in FIG. 3, the inventive thermal management system adjusts the coolant flow based upon a pressure at the coolant pressure sensor which is substantially lower than the predetermined threshold pressure 206 and even varies from the conventional pressure response 208 based upon a threshold pressure which may be selectively, and variably, optimized to provide, for example, a maximum reduction in emissions.

In another exemplary embodiment, the inventive thermal management system adjusts the coolant flow based upon a pressure at the coolant pressure sensor which may be selectively, and variably, optimized to provide, for example, optimum engine combustion temperatures or the like without limitation.

Figure 4:
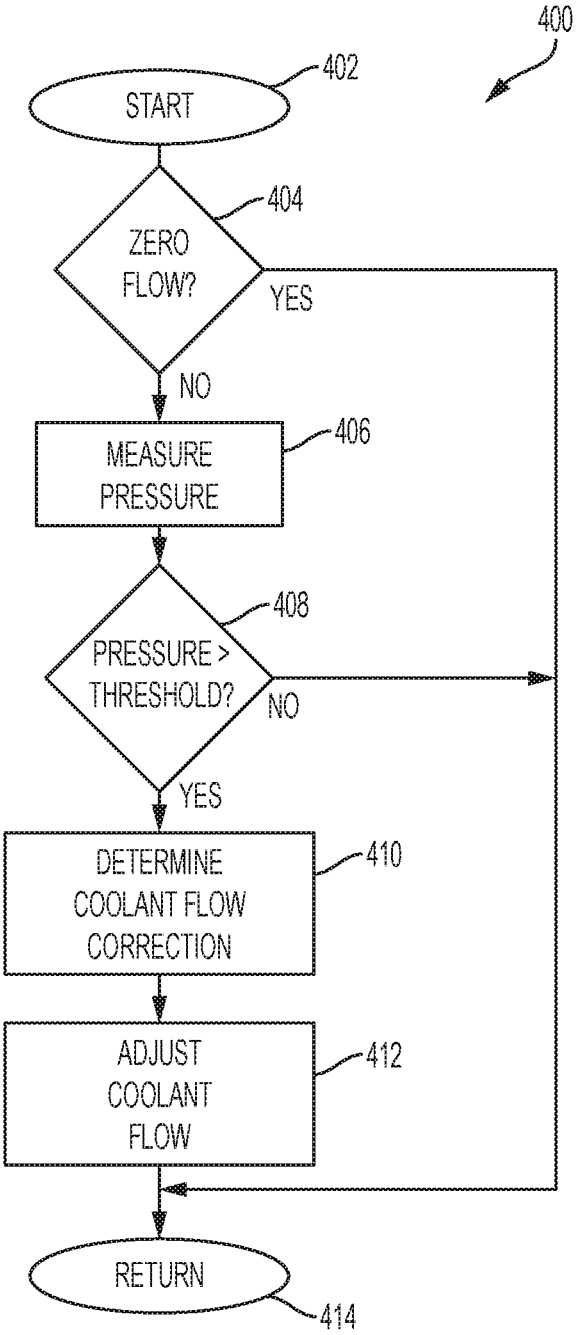
FIG. 4 illustrates a flowchart 400 of an exemplary method in accordance with the present disclosure.

FIG. 4 illustrates a flowchart 400 of an exemplary method in accordance with the present disclosure. The method starts at step 402 and continues to step 404. In step 404, the method determines whether the system is in an initial zero flow condition. If, in step 404, the method determines that the system is not or is no longer in an initial zero flow condition, then the method continues to step 406. In step 406, the method determines the coolant pressure from the coolant pressure sensor and continues to step 408. In step 408, the method determines whether the coolant pressure is greater than a threshold pressure. If in step 408, the method determines that the coolant pressure is greater than the threshold pressure, then the method continues to step 410. In step 410 the method determines a coolant flow correction. In an exemplary embodiment, the method may determine the coolant flow correction based upon the measured coolant pressure and/or any function of the coolant pressure signal such as, for example, a derivative of the coolant pressure signal, a difference between the coolant pressure signal and another pressure value, and the like without limitation. The present disclosure may determine the coolant correction in any manner so long as it is based upon the coolant pressure signal. The method then continues to step 412 where the method adjusts the flow of coolant from the coolant pump based upon the coolant correction and continues to step 414. In step 404, if the method determines that the system is in a zero-flow condition then the method continues to step 414. If, in step 408, the method determines that the pressure does not exceed the threshold pressure, then the method continues to step 414. In step 414, the method returns to the start at step 402.

This description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A thermal management system for a vehicle propulsion system, the system comprising:

an engine having a coolant inlet and a coolant outlet;

a coolant pump having an outlet in communication with the engine coolant inlet;

a pressure sensor in fluid communication with the engine coolant outlet and that generates a pressure signal indicative of a pressure in the engine coolant outlet;

a controller in communication with the pressure sensor and the coolant pump, wherein the controller is programmed to control a flow of coolant through the engine from the coolant pump based upon the pressure signal;

a second valve having a coolant inlet in communication with the engine coolant outlet and a plurality of coolant outlets;

a second heat exchanger having a coolant inlet in communication with a first of the plurality of valve coolant outlets and a coolant outlet in communication with the pump coolant inlet;

a third heat exchanger having a coolant inlet in communication with a second of the plurality of valve coolant outlets and a coolant outlet in communication with the pump coolant inlet; and a bypass fluid conduit having a coolant inlet in communication with a third of the plurality of valve coolant outlets and a coolant outlet in communication with the pump coolant inlet, wherein the controller is further programmed to determine a first potential benefit based upon a loss function of the second heat exchanger;

determine a second potential benefit based upon a loss function of the third heat exchanger;

compare the first potential to the second potential; and operate at least one of the first valve and the second valve to proportionally distribute coolant flow between the first heat exchanger, the second heat exchanger, the third heat exchanger, and the bypass fluid conduit based upon a result of the comparison.

2. The system of claim 1, further comprising an engine coolant outlet temperature sensor that provides an engine coolant outlet temperature signal to the controller.

3. The system of claim 2, further comprising a transmission fluid temperature sensor that provides a transmission fluid temperature signal to the controller, wherein the controller determines the first potential further based upon the engine coolant outlet temperature signal and the transmission fluid temperature signal.

* * * * *